US006232056B1

(12) United States Patent
Aylward et al.

(10) Patent No.: US 6,232,056 B1
(45) Date of Patent: May 15, 2001

(54) IMAGING ELEMENT WITH FUSER LAYER TO AID SPLICING

(75) Inventors: Peter T. Aylward, Hilton; Robert P. Bourdelais, Pittsford; Alphonse D. Camp, Rochester; Edgar E. Riecke, Pittsford; Dennis E. McGee, Penfield, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/217,232

(22) Filed: Dec. 21, 1998

(51) Int. Cl.[7] ..... G03C 1/85

(52) U.S. Cl. ..... 430/523; 430/527; 430/531; 430/533; 430/536; 428/480

(58) Field of Search ..... 430/523, 527, 430/531, 532, 533, 536; 428/480

(56) References Cited

U.S. PATENT DOCUMENTS

| | | | | |
|---|---|---|---|---|
| 3,234,025 | | 2/1966 | Van Hoof et al. . | |
| 3,411,908 | * | 11/1968 | Crawford et al. | 430/530 |
| 3,630,742 | | 12/1971 | Crawford et al. . | |
| 3,676,189 | | 7/1972 | Woodward et al. . | |
| 4,042,398 | * | 8/1977 | Holm et al. | 430/530 |
| 4,269,937 | * | 5/1981 | Asanuma et al. | 430/538 |
| 4,863,801 | | 9/1989 | Vallarino . | |
| 5,391,472 | | 2/1995 | Muys et al. . | |
| 5,395,743 | * | 3/1995 | Brick et al. | 430/496 |
| 5,698,384 | * | 12/1997 | Anderson et al. | 430/523 |
| 5,853,965 | | 12/1998 | Haydock et al. . | |
| 5,866,282 | | 2/1999 | Bourdelais et al. . | |
| 5,874,205 | | 2/1999 | Bourdelais et al. . | |
| 5,912,109 | * | 6/1999 | Anderson et al. | 430/530 |
| 6,022,677 | * | 2/2000 | Bourdelais et al. | 430/496 |
| 6,033,839 | * | 3/2000 | Smith et al. | 430/496 |
| 6,120,979 | * | 9/2000 | Majumdar et al. | 430/527 |
| 6,159,671 | * | 12/2000 | Matsuda | 430/505 |

FOREIGN PATENT DOCUMENTS

| | | |
|---|---|---|
| 0 880 065 A1 | 11/1998 | (EP) . |
| 0 880 067 A1 | 11/1998 | (EP) . |
| 0 880 069 A1 | 11/1998 | (EP) . |
| 2 325 749 | 12/1998 | (GB) . |
| 2 325 750 | 12/1998 | (GB) . |

OTHER PUBLICATIONS

Derwent, Japanese Abstact 57178868, 1982.
Derwent, Japanese Abstract 4,298,337, 1992
Derwent, Japanese Abstract 7,128,763, 1995.
Derwent, Japanese Abstract 7,128,764, 1995.

* cited by examiner

*Primary Examiner*—Hoa Van Le
*Assistant Examiner*—Amanda C. Walke
(74) *Attorney, Agent, or Firm*—Paul A. Leipold

(57) ABSTRACT

The invention relates to an imaging element comprising a bottom layer of writable conductive material and above said writable conductive material layer a fusible layer between said writable conductive material and a substrate.

14 Claims, 1 Drawing Sheet

IMAGING ELEMENT WITH FUSER LAYER TO AID SPLICING

FIELD OF THE INVENTION

This invention relates to photographic materials. In the preferred form it relates to base materials for photographic prints.

BACKGROUND OF THE INVENTION

In the formation of color paper it is known that the base paper has applied thereto a layer of polymer, typically polyethylene. This layer serves to provide waterproofing to the paper, as well as providing a smooth surface on which the photosensitive layers are formed. While the polyethylene does provide a waterproof layer to the paper, the melt extruded polyethylene layer on the backside of color photographic paper is coated with a functional layer that provides antistatic, writable, printable and frictional properties that aid the paper to be photofinished in a variety of equipment. Furthermore in the photofinishing of photographic paper, rolls of paper are exposed with customer negatives. When a roll of photographic is completely exposed, a second roll of non exposed paper may be spliced onto the end of the roll that was exposed. Spliced rolls provide efficiency to the photofinishing operation. Splices and are a way to join the ends of two or more rolls of photographic paper to make a larger roll of paper. Heat splices are commonly used in high speed printers. A heat splice is a device that supplies heat and pressure to two overlapping pieces of photographic paper. Two important criteria of heat splices are the strength of the bond and whether the paper sticks to the heat splice head. If the bond is too weak it can fail as the paper is transported through the printer, through the processor or through the cutter-sorter machines. If the paper sticks in the splice head, the printer cabinet must be opened to manually free up the paper and the paper in the machine is fogged. Photographic paper is conveyed through these machines at a high rate of speed. After the exposure step the rolls are then processed through photochemical processing solutions, dried and wound into rolls. The rolls are run through high speed cutters/choppers and finished into final customer prints. Throughout the photofinishing processing of exposure, processing, cutting and packaging it is important that the roll to roll splices have sufficient strength to hold the webs together without failure. If a splice breaks, there is considerable waste and expense incurred with reprints. This adds to the photofinisher cost and may delay a customer order or even worse it may result in the customer loosing invaluable pictures that are not readily be replaced.

It has been proposed in U.S. Pat. No. 5,244,861 to utilize biaxially oriented polypropylene in receiver sheets for thermal dye transfer. This invention provides a near photographic paper used in dye sublimation printers. The paper used in this process is in sheet form and therefore does not need to be spliced as is required for photographic applications. Japan Patent 7128764 reports the use of a water soluble polyester or copolymer comprising polyester and polyvinyl type polymers for improved adhesion for photographic X-rays materials and there is no indication of a fusible layer. Japan Patent application 7128763 refers to water soluble electroconductive materials.

In U.S. Pat. No. 5,391,472 an oriented polyester web is coated with a primer layer comprising a polythiohene, a latex polymer and a polymeric polyanion compound to provide good adhesion to the web substrate that withstands stretching.

U.S. Pat. No. 4,863,801 reports a crosslinked polymeric blend of at least two polymers comprising a reactive epoxy group and free H groups coated on a primed layer of ambifunctional silane coupling agent on a polyester substrate. Said layers provide good adhesion as well as some antistatic properties but does not adhere a separate antistatic layer to a substrate. In U.S. Pat. No. 3,234,025 reports a photographic element comprising a support and a layer of gelatin comprising a water soluble polyethyleneimine and urea is used to help prevent dye diffusion in the photographic image bearing colloid layers. U.S. Pat. No. 3,630,742 provides improved adhesion of emulsion to a polyester or polystyrene support with corona, polyethylene coating and a gelatin layer while U.S. Pat. No. 3,676,189 concerns itself with a polyolefin surface treated with a coating of an aqueous silica solution and a water insoluble film forming material for improved adhesion to photographic emulsions or printing inks. U.S. Pat. No. 4,042,398 provides improved adhesion of paper to a polyolefin film by applying an aqueous coating aluminum oxide.

In U.S. application Ser. No. 09/023,950, it has been proposed to use biaxially oriented sheet of polypropylene on both the top and bottom sides of photographic paper. This paper is coated with backside functional layers to enhance the antistatic and frictional performance of the paper. The backside polymer layer is predominately polypropylene with a terpolymer to provide a matte appearing surface. Since these polymers are dissimilar, there are discrete dominates of polymer that have slightly different chemical and physical properties. These differences can make it difficult to adhere materials such as an antistat to the surface. When compared to polyethylene, it is more difficult to adhere materials to a polypropylene surface. There remains a need for an improved means to adhere other chemicals to the surface of polypropylene.

PROBLEM TO BE SOLVED BY THE INVENTION

There is a need to improve the splicing of imaging materials for photofinishing.

SUMMARY OF THE INVENTION

It is an object of the invention to provide an imaging material that overcomes disadvantages of present products.

It is another object to have an stronger splicing strength for photofinishing

It is an additional object to provide a method and an imaging element with enhanced performance during photofinishing It is an additional object of this invention to reduce sticking to the heat splice heads in photofinishing equipment.

These and other objects of the invention are accomplished by an imaging element comprising a bottom layer of writable conductive material and above said writable conductive layer a fusible layer between said writable conductive material and a substrate.

ADVANTAGEOUS EFFECT OF THE INVENTION

The invention provides imaging print elements having a fusible layer to improve the strength of photofinishing splices.

DETAILED DESCRIPTION OF THE INVENTION

Figure 1:
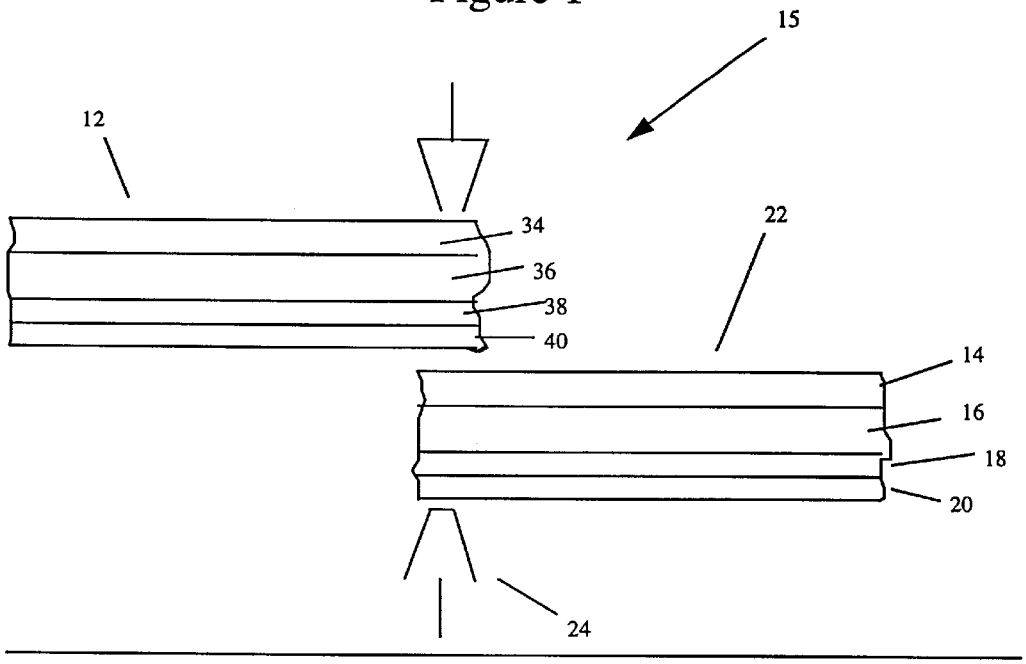
FIG. 1 is a schematic illustration of the splicing process.

The invention has numerous advantages over prior practices in the art. The invention provides an imaging element that has a fusible layer on the backside of said element that has enhanced adhesion for photofinishing splicing. On the backside of photographic papers there is traditionally a layer that has a degree of electrical conductivity to prevent static discharge during high speed manufacturing operations for photographic papers. In addition, the backside layer also provides some enhanced frictional properties that aid paper conveyance during photofinishing. It is critical that the backside functional layer also has sufficient adhesion to the imaging base substrate to survive chemical processing and also be able to be tack welded to the emulsion side of a second roll. Splices are a way to joint the ends of two or more rolls of photographic paper to make a larger roll of paper. Heat splices are commonly used in high speed printers. A heat splice is a device that supplies heat and pressure to two overlapping pieces of photographic paper. During the splicing the heat causes the back of one piece of paper to bond with the front of the other piece of paper. Two important criteria of heat splices are the strength of the bond and whether the paper sticks to the heat splice head. If the bond is too weak it can fail when the paper transports through the printer, through the processor or through the cutter-sorter machines. If the paper sticks in the splice head the printer cabinet must be opened to manually free up the paper and the paper in the machine is fogged. Such a tack weld splice must also have sufficient strength to hold the two webs together during the photofinishing steps. This invention provides for improved splice strength as well as a reduced propensity of sticking to the splice head in photofinishing equipment.

An embodiment of this invention provides an imaging element comprising a bottom layer of writable conductive material and above said writable conductive material layer a fusible layer between said writable conductive material and a substrate. In a preferred embodiment said fusible layer comprises polyethyleneimine. Polyethyleneimine is preferred because it adheres very well to polypropylene as well as to the conductive writable layer and provides greatly enhanced splice strength in photofinishing applications. In addition it is relatively inexpensive and provides effective performance features at very low coverage. The polyethyleneimine is coated at about 0.001 to 0.015 g/m$^2$. Higher coverage may be used but generally have only marginal additional benefit at a higher cost. The polyethylene used has a molecular weight number average of approximately 70,000 as determined by osmotic pressure. The polyethyleneimine may be applied by any known coating method such as roller, transfer roller, gravure, spray, air knife, rod or combination thereof, slot die, curtain and others. In the embodiment of this invention, the top layer comprises image layers that further comprise gelatin. Image layer refer to silver halide light sensitive emulsion, ink jet receiving layers, thermal dye transfer layers and electrophotographic layers.

Such an element has greatly enhanced splicing properties in photofinishing equipment. During photofinishing the bottom most layer which in this case is a writable conductive layer is brought in direct contact with the emulsion side of a second roll of imaging material. The layer that is in contact with the writable conductive layer is referred to as the overcoat which comprises gelatin. The two webs are brought into contact with each other and a heating anvil applies heat from at least one side of the two webs and in some equipment from both sides. Sufficient heat is applied to the web to cause the surface polymer layer of the substrate base to soften and flow. While the splice that is formed is not a direct result of the two surface polymer layers fusing together, the splice is a result of the backside writable conductive layer and the gelatin of the emulsion over coat forming a bond. It has been found that during this process that the top most polymer layer of the imaging substrate softens. During this process materials that previously have been adhered to said polymer surface may not readily adhere upon cooling. The surface chemistry of the substrate polymer plays a critical role in the amount of readhesion as well as the type of materials that are being readhered to it. In the case of traditional photographic paper that has a polyethylene backside substrate polymer layer, there are a variety of materials that will adhere and readhere after softening during splicing as opposed to a polypropylene. Even with polyethylene, once the substrate polymer softens in general there is less adhesion then before softening. This can create a situation in which the weak point of a photofinishing splice is the adhesion of the writable conductive layer to the bottom most polymer layer of the substrate. This creates an opportunity for improve heat splice adhesion . By using a fusing layer that has a sufficiently low glass transition as an intermediate layer between said writable conductive layer and said bottom polymer substrate, the readhesion of the writable conductive layer to the base substrate. In the embodiment of this invention an imaging element comprising a bottom layer of writable conductive material and above said writable conductive material layer a fusible layer between said writable conductive material and a substrate. Said fusible layer comprises a polymer that has a glass transition between 0 to 55° C. The performance of said fusible layer comprises a material that has a splice peel strength of at least 100 g/0.25 cm at a temperature of between 90° C. to 205° C. at a dwell time of between 2 and 10 seconds under a pressure of at least 413.7 MPa Said fusible layer between the writable conductive material layer and the substrate comprises at least one material selected from the group consisting of polyethyleneimine, polyvinylimine, aminated polymers, modified polymers by reacting acrylic polymers with acid groups with ethylene amines.

An additional embodiment provides an imaging element comprising a bottom layer of writable conductive material and above said writable conductive material layer a fusible layer between said writable conductive material and a substrate wherein said substrate comprises paper having at least a polymer layer on the bottom. A preferred polymer material on the bottom of this embodiment comprises biaxially oriented polymer sheet. The biaxially oriented polymer sheet is preferred because it provides functional strength properties that help to balance the curl properties of the imaging element as well as to provide good frictional properties that aid in transport through photofinishing equipment. In the case of imaging elements the most preferred element comprises at least one polymer sheet. In this case a polymer sheet such as biaxially oriented polyolefin or biaxially oriented polyester or polyamides, a sheet of such polymer should be on the top side of the base substrate under the silver halide emulsion and there should also be a sheet on the bottom side of the base substrate but between the fusible layer and the base substrate.

A further embodiment of this invention comprises an imaging element comprising a bottom layer of writable conductive material and above said writable conductive material layer a fusible layer between said writable conductive material and a substrate further comprising a polymer layer on the bottom that comprises a melt extruded polyethylene. Said substrate should comprises at least one melt extruded polyethylene polymer layer and further comprises a layer of melt extruded polyethylene on the top side of the base substrate under the silver halide emulsion as well as a layer of polyethylene on the bottom side of the base substrate but between the fusible layer and the base substrate. In addition layers of polymer may also be used in combination with sheets of biaxially oriented polymer to enhance the adhesion of the biaxially oriented sheets to the base substrate. The polymer may be a polyolefin, polyester, polyamide, co and ter polymer of said polymer, adhesives and other polymers known in the art to promote adhesion between a base substrate and a polymer sheet. In a preferred embodiment an imaging element comprising a bottom layer of writable conductive material and above said writable conductive material layer a fusible layer between said writable conductive material and a substrate further comprising at least one polymer sheet wherein said substrate comprises polyester. A polyester substrate is desirable in certain applications such as displays or advertising to provide a good balance in reflection, transmission and diffusivity properties of the final imaging element. A polyester substrate further provides imaging material that have minimal sensitivity to humidity induced curl, have excellent sharpness and gloss properties that are highly desirable in imaging print materials. Furthermore it is desirable to have a polyester substrate that further comprises at least one sheet of biaxially oriented polymer adhered to the substrate.

The writable conductive layer of the embodiments of this invention should have a surface resistivity of at least $10^{13}$ ohms per square. This helps to prevent or minimize the amount of electrical charge the accumulates on the surface during high conveyance and winding of rolls. Electrical discharges in the form of static sparks can form fog spots on processed light sensitive emulsions. In the case of other imaging systems that conductance of charge is important for sheet feed printers to prevent static cling of sheets in a stack. In such a case multi sheets could be fed into a printer. Charge control agents may be added to the top layer of the imaging layers as well as to the bottom conductive writable layer to further minimize charging differential that may cause static with high speed unwinding.

In the field of photofinishing it is important to have a back surface of the writable conductive layer with a surface roughness of between 0.3 to 2.0 $\mu$m as measured by a stylus profiler. The roughness characteristic is important in developing the appropriate coefficient of friction to aid in the transport of the web or sheet in photofinishing equipment as well as printers that are common in the area of ink jet, thermal dye sublimation and electrophotography.

In the area of photofinishing there are devices that expose rolls of light sensitive photographic imaging member at high speeds. In these devices a second roll of light sensitive imaging member is automatically spliced onto the top or bottom side of the roll that was just exposed by applying heat and pressure. The splice is required to be of sufficient strength to transport through wet photo processing solutions as well as high speed cutter and packers. In a splice fails during any of these processes, there is considerable waste and time that is lost to reexpose and process a customer order. In a method of this invention a first imaging member comprising an imaging element comprising a bottom layer of writable conductive material and above said writable conductive material layer a fusible layer between said writable conductive material and a substrate wherein the top most layer of the imaging element comprises gelatin, providing a second imaging member comprising an imaging element comprising a bottom layer of writable conductive material and above said writable conductive material layer a fusible layer between said writable conductive material and a substrate wherein the top most layer of the imaging element comprises gelatin, bringing the bottom of said first imaging member into contact with the top of said second imaging member, applying heat and pressure to fuse the imaging members. Furthermore the method of fusing said imaging members applies heat by at least one anvil at a temperature of between 90° C. to 205° C. for a time period of between 2 and 10 seconds. The method of said fusing of this invention is at a pressure of 34.5 and 413.7 MPa The terms as used herein, "top", "upper", "emulsion side", and "face" mean the side or towards the side of an imaging member bearing the imaging layers or developed image. The terms "bottom", "lower side", and "back" mean the side or towards the side of the imaging member opposite from the side bearing the imaging layers or developed image. The term "tie layer" as used herein refers to a layer of material that is used to adhere biaxially oriented sheets to a base such as paper, polyester, fabric, or other suitable material for the viewing of images. The term "strippable polymer sheet" refers to a layer that is initially attached to the backside of the imaging element and that can be removed from the imaging element and there is an adhesive attached to the polymer sheet that has been removed.

In addition the imaging element comprising a bottom layer of writable conductive material comprises at least one material selected from the group consisting of aluminum modified colloidal silica, polyethylene oxide, salts, metallic salts, quaternary salts, quaternary acrylic copolymer latexes, polyethyloxazoline, polyethyleneimine, electroconductive polymers, conductive polymers having sulphonic acid or carboxylic acid groups, crystalline single-phase, conductive metal-containing particles comprising tin-doped indium sesquioxide, niobium-doped titanium dioxide, metal nitrides, carbides, silicides, borides, antimony-doped tin oxide.

The present invention consists of a multilayer sheets of biaxially oriented polymer which are attached to both the top and bottom of a photographic quality paper support by melt extrusion of a polymer tie layer. Oriented sheets are generally preferred in this invention because of their high strength properties and resistance to yielding when placed under a load. These properties are important to reduce curl in the final product as well as providing a repositionable sheet that does not stretch when removed from the backside. Any suitable biaxially oriented polymer sheet may be used for the sheet on the top side of the laminated base used in the invention. Microvoided composite biaxially oriented sheets are preferred and are conveniently manufactured by coextrusion of the core and surface layers, followed by biaxially orientation, whereby voids are formed around void-initiating material contained in the core layer. Such composite sheets may be formed as in U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

Composite Sheet Density×100=% of Solid Density Polymer Density

Percent solid density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 μm, preferably from 20 to 70 μm. Below 20 μm, the microvoided sheets may not be thick enough to minimize any inherent non-planarity in the support and would be more difficult to manufacture. At thickness higher than 70 μm, little improvement in either surface smoothness or mechanical properties are seen, and so there is little justification for the further increase in cost for extra materials.

The biaxially oriented sheets that have been used in this invention may contain a plurality of layers in which at least one of the layers contains voids. The voids provide added opacity to the imaging element. This voided layer can also be used in conjunction with a layer that contains at least one pigment from the group consisting of: $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides additional advantages in the optical performance of the final imaging element. The imaging element may have either a photographic silver halide and dye forming coupler emulsion or an image receiving layer typically used for thermal dye sublimation or ink jet.

"Void" is used herein to mean devoid of added solid and liquid matter, although it is likely the "voids" contain gas and void initiating particles. The void-initiating particles which remain in the finished packaging sheet core should be from 0.1 to 10 μm in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

The void-initiating material may be selected from a variety of materials, and should be present in an amount of about 5 to 50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar-C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2$=C(R')—C(O)(OR) wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2$=CH(O)COR, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the crosslinked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethyl-propane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin sheet is utilized.

For the biaxially oriented sheet on the top side toward the emulsion, suitable classes of thermoplastic polymers for the biaxially oriented sheet and the core matrix-polymer of the preferred composite sheet comprise polyolefins. Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties. Polyesters, polyamides and other polymer can be also be used.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

Addenda may be added to the core matrix and/or to the skins to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet. For photographic use, a white base with a slight bluish tint is preferred.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. After the sheet has been stretched, it is heat set by heating to a temperature sufficient to crystallize or anneal the polymers while restraining to some degree the sheet against retraction in both directions of stretching.

The composite sheet, while described as having preferably at least three layers of a microvoided core and a skin layer on each side, may also be provided with additional layers that may serve to change the properties of the biaxially oriented sheet. A different effect may be achieved by additional layers. Such layers might contain tints, antistatic materials, or different void-making materials to produce sheets of unique properties. Biaxially oriented sheets could be formed with surface layers that would provide an improved adhesion, or look to the support and photographic element. The biaxially oriented extrusion could be carried out with as many as 10 or more layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, coating polyvinylidene chloride for heat seal properties. Further examples include flame, plasma or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a preferred biaxially oriented top sheet where the photographic imaging layers are coated on the polyethylene layer is a follows:

Polyethylene with blue tint

Polypropylene with optical brightener and 24% anatase $TiO_2$

Voided polypropyele

Polypropylene with 18% rutile $TiO_2$

The sheet on the side of the base paper opposite to the emulsion layers may be any suitable sheet. The sheet may or may not be microvoided. It may have the same composition as the sheet on the top side of the paper backing material. Biaxially oriented sheets are conveniently manufactured by coextrusion of the sheet, which may contain several layers, followed by biaxial orientation. Such biaxially oriented sheets are disclosed in, for example, U.S. Pat. No. 4,764,425, the disclosure of which is incorporated for reference.

The preferred biaxially oriented sheet is a biaxially oriented polyolefin sheet, most preferably a sheet of polyethylene or polypropylene. The thickness of the biaxially oriented sheet should be from 10 to 150 $\mu$m. Below 15 $\mu$m, the sheets may not be thick enough to minimize any inherent non-planarity in the support and would be more difficult to manufacture. At thickness higher than 70 $\mu$m, little improvement in either surface smoothness or mechanical properties are seen, and so there is little justification for the further increase in cost for extra materials.

The biaxially oriented sheets of the invention preferably have a water vapor permeability that is less than $0.85\times10^{-5}$ g/mm$^2$/day. This allows faster emulsion hardening, as the laminated support of this invention greatly slows the rate of water vapor transmission from the emulsion layers during coating of the emulsions on the support. The transmission rate is measured by ASTM F1249.

Suitable classes of thermoplastic polymers for the biaxially oriented sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Suitable polyolefins include polypropylene, polyethylene, polymethylpentene, and mixtures thereof. Polyolefin copolymers, including copolymers of propylene and ethylene such as hexene, butene and octene are also useful. Polypropylenes are preferred because they are low in cost and have good strength and surface properties.

Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. No. 2,465,319 and U.S. Pat. No. 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402 and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The biaxially oriented sheet on the back side of the laminated base can be made with layers of the same polymeric material, or it can be made with layers of different polymeric composition. For compatibility, an auxiliary layer can be used to promote adhesion of multiple layers.

Addenda may be added to the biaxially oriented back side sheet to improve the whiteness of these sheets. This would include any process which is known in the art including adding a white pigment, such as titanium dioxide, barium sulfate, clay, or calcium carbonate. This would also include adding fluorescing agents which absorb energy in the UV region and emit light largely in the blue region, or other additives which would improve the physical properties of the sheet or the manufacturability of the sheet.

The coextrusion, quenching, orienting, and heat setting of these biaxially oriented sheets may be effected by any process which is known in the art for producing oriented sheet, such as by a flat sheet process or a bubble or tubular process. The flat sheet process involves extruding or coextruding the blend through a slit die and rapidly quenching the extruded or coextruded web upon a chilled casting drum so that the polymer component(s) of the sheet are quenched below their solidification temperature. The quenched sheet is then biaxially oriented by stretching in mutually perpendicular directions at a temperature above the glass transition temperature of the polymer(s). The sheet may be stretched in one direction and then in a second direction or may be simultaneously stretched in both directions. After the sheet has been stretched, it is heat set by heating to a temperature sufficient to crystallize the polymers while restraining to some degree the sheet against retraction in both directions of stretching.

The biaxially oriented sheet on the back side of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability, and coating polyvinylidene chloride for heat seal properties. Further examples include flame, plasma or corona discharge treatment to improve printability or adhesion.

The structure of a preferred biaxially oriented sheet polyolefin sheet that may be laminated to the bottom side of the base with the core layer towards the top is as follows:

Polyethylene

Polyester core

The support to which the microvoided composite sheets and biaxially oriented sheets are laminated for the laminated support of the photosensitive silver halide layer may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312 and 5,055,371.

The preferred support is a photographic grade cellulose fiber paper. When using a cellulose fiber paper support, it is preferable to extrusion laminate the microvoided composite sheets to the base paper using a polyolefin resin. Extrusion laminating is carried out by bringing together the biaxially oriented sheets of the invention and the base paper with application of an adhesive between them followed by their being pressed in a nip such as between two rollers. The adhesive may be applied to either the biaxially oriented sheets or the base paper prior to their being brought into the nip. In a preferred form the adhesive is applied into the nip simultaneously with the biaxially oriented sheets and the base paper. The adhesive may be any suitable material that does not have a harmful effect upon the photographic element. A preferred material is polyethylene that is melted at the time it is placed into the nip between the paper and the biaxially oriented sheet.

During the lamination process, it is desirable to maintain control of the tension of the biaxially oriented sheets in order to minimize curl in the resulting laminated support. For high humidity applications (>50% RH) and low humidity applications (<20% RH), it is desirable to laminate both a front side and back side film to keep curl to a minimum.

The surface roughness of this invention can also be accomplished by laminating a biaxially oriented sheet to a paper base that has the desired roughness. The roughness of the paper base can be accomplished by any method known in the art such as a heated impression nip or a press felt combined with a roller nip in which the rough surface is part of the press nip. The preferred roughness of the base paper is from 35 $\mu$m to 150 $\mu$m. This preferred range is larger than roughness range for the imaging support because of the loss of roughness that occurs in melt extrusion lamination.

In one preferred embodiment, in order to produce photographic elements with a desirable photographic look and feel, it is preferable to use relatively thick paper supports (e.g., at least 120 mm thick, preferably from 120 to 250 mm thick) and relatively thin microvoided composite sheets (e.g., less than 50 mm thick, preferably from 20 to 50 mm thick, more preferably from 30 to 50 mm thick).

In the present invention, the backside of the substrate is permanently laminated with a biaxially oriented sheet of polymer that is joined to the base substrate with an adhesive. A second strippable and repositionable biaxially oriented sheet that is transparent is applied on the back of the laminated substrate with a peelable repositionable adhesive. The strippable second sheet is pressure laminated to the bottom side of the first bottom sheet with the adhesive between the strippable sheet and the permanent bottom sheet bottom sheets. While strippable polymer layers that are directly extruded to the base substrate may be used, the biaxially oriented sheets are preferred because of their high strength properties and their ability to resist dimensional change. It is important to be able to balance the overall curl properties of the final imaged structure. Again biaxially oriented sheets are best for this application because of the ability to align strength properties of the base and polymer sheets.

Any suitable biaxially oriented polymer sheet may be used for the transparent peelable or repositionable sheet that is applied to the backside of the laminated imaging element. Biaxially oriented sheets are conveniently manufactured by coextrusion of the sheet, which may contain several layers, followed by biaxially orientation. Such biaxially oriented sheets are disclosed in, for example, U.S. Pat. No. 4,764,425.

Preferred classes of thermoplastic polymers for the biaxially oriented repositionable sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Preferred polyolefins include polypropylene, polyethylene, polymethylpentene, and mixtures thereof Polyolefm copolymers, including copolymers of propylene and ethylene such as hexene, butene and octene are also useful. Polypropylenes are preferred because they are low in cost and have good strength and surface properties.

Preferred polyesters include those produced from aromatic, aliphatic or cycloaliphatic dicarboxylic acids of 4–20 carbon atoms and aliphatic or alicyclic glycols having from 2–24 carbon atoms. Polyesters are preferred because these polymer have a high modulus and resist stretching when they are removed from the backside and applied over the image. Polymer sheets made from polyesters are also very durable during handling as well as providing a high degree of gloss to the final product. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well known techniques, e.g., those described in U.S. Pat. No. 2,465,319 and U.S. Pat. No. 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607, 4,459,402 and 4,468,510.

Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The repositionable biaxially oriented sheet on the back side of the laminated base, while described as having preferably at least one layer, may also be provided with additional layers that may serve to change the properties of the biaxially oriented sheet. A different effect may be achieved by additional layers. Such layers might contain tints, antistatic materials, or slip agents to produce sheets of unique properties. Biaxially oriented sheets could be formed with surface layers that would provide an improved adhesion, or look to the support and photographic element. The biaxially oriented extrusion could be carried out with as many as 10 layers if desired to achieve some particular desired property.

The preferred thickness of the repositionable sheet of this invention is between 6 to 100 micrometers. Below 4 micrometers the web is difficult to convey through manufacturing and the photographic printers and its strength properties are sufficiently low to cause problems when being repositioned. Above 120 $\mu$m, there is little benefits to justify the additional material costs.

These biaxially oriented sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photo sensitive layers. Examples of this would be acrylic coatings for printability and a coating polyvinylidene chloride for heat seal properties. Further examples include flame, plasma or corona discharge treatment to improve printability or adhesion.

As used herein the phrase "imaging element" is a material that may be used as a laminated support for the transfer of images to the support by techniques such as ink jet printing or thermal dye transfer as well as a support for silver halide images. As used herein, the phrase "photographic element" is a material that utilizes photosensitive silver halide in the formation of images. In the case of thermal dye transfer or ink jet, the image layer that is coated on the imaging element may be any material that is known in the art such as gelatin, pigmented latex, polyvinyl alcohol, polycarbonate, polyvinyl pyrrolidone, starch and methacrylate. The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process,* Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11), and low pAg (pAg 1–7) ripening are discussed by S. Collier in *Photographic Science and Engineering,* 23, 113 (1979). Examples of processes for preparing intentionally reduction sensitized silver halide emulsions are described in EP 0 348 934 A1 (Yamashita), EP 0 369 491 (Yamashita), EP 0371 388 (Ohashi), EP 0 396 424 A1 (Takada), EP 0 404 142 A1 (Yamada), and EP 0 435 355 A1 (Makino).

The photographic elements of this invention may use emulsions doped with Group VIII metals such as iridium, rhodium, osmium, and iron as described in *Research Disclosure, September* 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

The elements of the invention may use materials as disclosed in *Research Disclosure,* 40145, September 1997, particularly the couplers as disclosed in Section II of the Research Disclosure.

In the following Table, reference will be made to (1) *Research Disclosure,* December 1978, Item 17643, (2)

*Research Disclosure,* December 1989, Item 308119, and (3) *Research Disclosure,* September 1994, Item 36544, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and the images contained therein.

| Reference | Section | Subject Matter |
|---|---|---|
| 1 | I, II | Grain composition, |
| 2 | I, II, IX, X, XI, | morphology and preparation. |
| | XII, XIV, XV | Emulsion preparation |
| | I, II, III, IX | including hardeners, coating |
| 3 | A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | |
| 2 | VI | Antifoggants and stabilizers |
| 3 | VII | |
| 1 | VIII | Absorbing and scattering |
| 2 | VIII, XIII, XVI | materials; Antistatic layers; |
| 3 | VIII, IX C & D | matting agents |
| 1 | VII | Image-couplers and image- |
| 2 | VII | modifying couplers; Dye |
| 3 | X | stabilizers and hue modifiers |
| 1 | XVII | |
| 2 | XVII | Supports |
| 3 | XV | |
| 3 | XI | Specific layer arrangements |
| 3 | XII, XIII | Negative working emulsions; |
| | | Direct positive emulsions |
| 2 | XVIII | Exposure |
| 3 | XVI | |
| 1 | XIX , XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultraviolet, visible, and infrared regions of the electromagnetic spectrum, as well as with electron beam, beta radiation, gamma radiation, X-ray, alpha particle, neutron radiation, and other forms of corpuscular and wave-like radiant energy in either noncoherent (random phase) forms or coherent (in phase) forms, as produced by lasers. When the photographic elements are intended to be exposed by X-rays, they can include features found in conventional radiographic elements.

The laminated substrate of the invention may have copy restriction features incorporated such as disclosed in U.S. application Ser. No. 08/598,785 filed Feb. 8, 1996 and U.S. Pat. No. 5,752,152 filed on the same day. These applications disclose rendering a document copy restrictive by embedding into the document a pattern of invisible microdots. These microdots are, however, detectable by the electro-optical scanning device of a digital document copier. The pattern of microdots may be incorporated throughout the document. Such documents may also have colored edges or an invisible microdot pattern on the back side to enable users or machines to read and identify the media. The media may take the form of sheets that are capable of bearing an image. Typical of such materials are photographic paper and film materials composed of polyethylene resin coated paper, polyester, (poly)ethylene naphthalate, and cellulose triacetate based materials.

The microdots can take any regular or irregular shape with a size smaller than the maximum size at which individual microdots are perceived sufficiently to decrease the usefulness of the image, and the minimum level is defined by the detection level of the scanning device. The microdots may be distributed in a regular or irregular array with center-to-center spacing controlled to avoid increases in document density. The microdots can be of any hue, brightness, and saturation that does not lead to sufficient detection by casual observation, but preferably of a hue least resolvable by the human eye, yet suitable to conform to the sensitivities of the document scanning device for optimal detection.

In one embodiment the information-bearing document is comprised of a support, an image-forming layer coated on the support and pattern of microdots positioned between the support and the image-forming layer to provide a copy restrictive medium. Incorporation of the microdot pattern into the document medium can be achieved by various printing technologies either before or after production of the original document. The microdots can be composed of any colored substance, although depending on the nature of the document, the colorants may be translucent, transparent, or opaque. It is preferred to locate the microdot pattern on the support layer prior to application of the protective layer, unless the protective layer contains light scattering pigments. Then the microdots should be located above such layers and preferably coated with a protective layer. The microdots can be composed of colorants chosen from image dyes and filter dyes known in the photographic art and dispersed in a binder or carrier used for printing inks or light-sensitive media.

In a preferred embodiment the creation of the microdot pattern as a latent image is possible through appropriate temporal, spatial, and spectral exposure of the photosensitive materials to visible or non-visible wavelengths of electromagnetic radiation. The latent image microdot pattern can be rendered detectable by employing standard photographic chemical processing. The microdots are particularly useful for both color and black-and-white image-forming photographic media. Such photographic media will contain at least one silver halide radiation sensitive layer, although typically such photographic media contain at least three silver halide radiation sensitive layers. It is also possible that such media contain more than one layer sensitive to the same region of radiation. The arrangement of the layers may take any of the forms known to one skilled in the art, as discussed in Research Disclosure 37038 of February 1995.

The following examples illustrate the practice of this invention. They are not intended to be exhaustive of all possible variations of the invention. Parts and percentages are by weight unless otherwise indicated.

Commercial Grade Paper of Examples

A photographic paper support was produced by refining a pulp furnish of 50% bleached hardwood kraft, 25% bleached hardwood sulfite, and 25% bleached softwood sulfite through a double disk refiner, then a Jordan conical refiner to a Canadian Standard Freeness of 200 cc. To the resulting pulp furnish is added 0.2% alkyl ketene dimer, 1.0% cationic cornstarch, 0.5% polyamide-epichlorohydrin, 0.26 anionic polyacrylamide, and 5.0% $TiO_2$ on a dry weight basis. An about 227g/m$^2$ bone dry weight base paper is made on a fourdrinier paper machine, wet pressed to a solid of 42%, and dried to a moisture of 10% using steam-heated dryers achieving a Sheffield Porosity of 160 Sheffield Units and an apparent density 0.70 g/cc. The paper base is then surface sized using a vertical size press with a 10% hydroxyethylated cornstarch solution to achieve a loading of 3.3 wt. % starch. The surface sized support is calendered to an apparent density of 1.04 gm/cc.

Coating Format 1 Utilized in Examples

| Coating Format 1 | Laydown mg/m$^2$ |
|---|---|
| Layer 1 Blue Sensitive Layer | |
| Gelatin | 1300 |
| Blue sensitive silver | 200 |
| Y-1 | 440 |
| ST-1 | 440 |
| S-1 | 190 |
| Layer 2 Interlayer | |
| Gelatin | 650 |
| SC-1 | 55 |
| S-1 | 160 |
| Layer 3 Green Sensitive | |
| Gelatin | 1100 |
| Green sensitive silver | 70 |
| M-1 | 270 |
| S-1 | 75 |
| S-2 | 32 |
| ST-2 | 20 |
| ST-3 | 165 |
| ST-4 | 530 |
| Layer 4 UV Interlayer | |
| Gelatin | 635 |
| UV-1 | 30 |
| UV-2 | 160 |
| SC-1 | 50 |
| S-3 | 30 |
| S-1 | 30 |
| Layer 5 Red Sensitive Layer | |
| Gelatin | 1200 |
| Red sensitive silver | 170 |
| C-1 | 365 |
| S-1 | 360 |
| UV-2 | 235 |
| S-4 | 30 |
| SC-1 | 3 |
| Layer 6 UV Overcoat | |
| Gelatin | 440 |
| UV-1 | 20 |
| UV-2 | 110 |
| SC-1 | 30 |
| S-3 | 20 |
| S-1 | 20 |
| Layer 7 SOC | |
| Gelatin | 490 |
| SC-1 | 17 |
| $SiO_2$ | 200 |
| Surfactant | 2 |

APPENDIX

Y-1

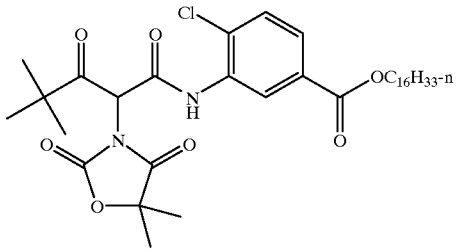

ST-1 = N-tert-butylacrylamide/n-butyl acrylate copolymer (50:50)

S-1 = dibutyl phthalate

SC-1

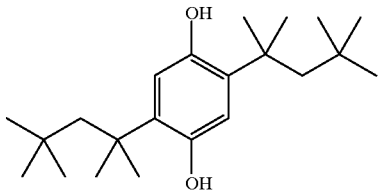

M-1

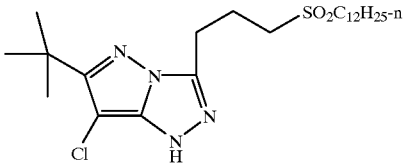

S-2 = diundecyl phthalate

ST-2

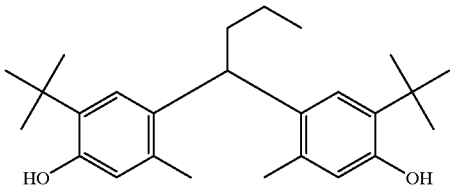

ST-3

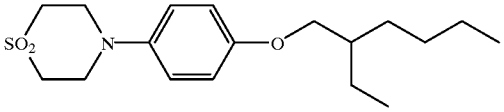

ST-4

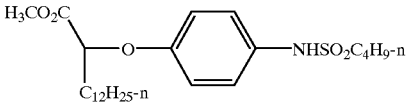

UV-1

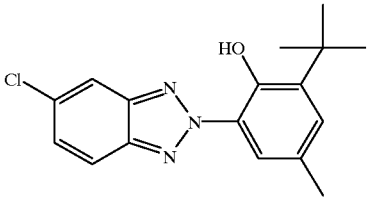

-continued

UV-2

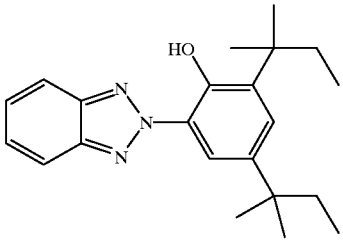

S-3 = 1,4-Cyclohexyldimethylene bis(2-ethylhexanoate)

C-1

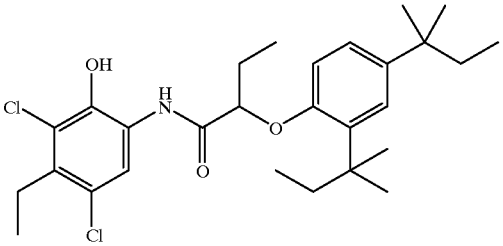

S-4 = 2-(2-Butoxyethoxy)ethyl acetate

Dye 1

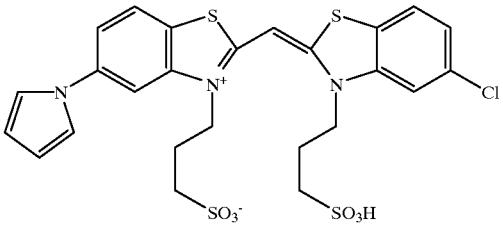

In this example, a photographic imaging element with a fuser layer to improve roll to roll heat splicing (sample C) was compared to two control materials that did not utilize the fuser layer of this invention (sample A and B). This example will show the significant improvement is heat splice strength between the invention and the control materials by measuring the strength of a heat splice.

Sample A (control)

This sample comprises a standard photographic paper base as describe above which has been coated with a layer of low density pigmented polyethylene at a coverage of 29.3 g/m$^2$ on the top side and a layer of low density polyethylene on the backside at 26.8 g/m$^2$. On the backside polyethylene layer, an antistatic layer was coated. The anitstat comprises primarily an acrylic binder with conductive salts. The same antistat was used for all samples.

Sample B (control)

The structure of imaging element B was as follows:

| |
|---|
| L1: Image layers |
| L2: Top biaxially oriented polymer layers ( 5 layers) |
| L3: Polyethylene tie layer |
| L4: Cellulose paper |
| L5: Polyethylene tie layer |
| L6: Backside biaxially oriented polymer layer (2 Layers) |
| L7: Writable / Conductive Layer |

The layer description for imaging element B were as follows:

L1: Photographic Emulsion Layers (The top most layer of the emulsion is primarily gelatin and acts as an overcoat to protect the emulsion)

L2: The top biaxially oriented polymer layer is 5 layers that is approximately 1.4 mils in total thickness comprising a thin top layer of polyethylene, a second layer of pigmented (TiO2) polypropylene, a voided core layer of polypropylene utilizing a polybutylteraphlate void initiating particle, a 4th and 5th layer of clear polypropylene. This polymer sheet is cast and biaxially oriented.

L3: This is a melt polymer layer of low density polyethylene to provide adhesion between the base and biaxially oriented sheet.

L4: For the purpose of this example a standard photographic paper base was used.

L5: This is a melt polymer layer of low density polyethylene to provide adhesion between the base and biaxially oriented sheet.

L6: Is a 2 layer matte film of biaxially oriented polypropylene with the matte side next to the fusible layer. The matte layer is a terpolymer mixture of propylene, ethylene and butylene.

L7: The writable conductive layer is a mixture of an acrylic latex, a conductive salt, colloidal silica and coating surfactant.

Sample C (invention)

The structure of sample C was as follows:

| |
|---|
| L1: Image layers |
| L2: Top biaxially oriented polymer layers (5 layers) |
| L3: Polyethylene tie layer |
| L4: Cellulose paper |
| L5: Polyethylene tie layer |
| L6: Backside biaxially oriented polymer layer (2 Layers) |
| L7: Fusible Layer |
| L8: Writable / Conductive Layer |

The layer description for sample C was as follows:

L1: Photographic Emulsion Layers (The top most layer of the emulsion is primarily gelatin and acts as an overcoat to protect the emulsion )

L2: The top biaxially oriented polymer layer is 5 layers that is approximately 1.4 mils in total thickness comprising a thin top layer of polyethylene, a second layer of pigmented (TiO2) polypropylene, a voided core layer of polypropylene utilizing a polybutylteraphlate void initiating particle, a 4th and 5th layer of clear polypropylene. This polymer sheet is cast and biaxially oriented.

L3: This is a melt polymer layer of low density polyethylene coated at 12.2 g/m$^2$ to provide adhesion between the base and biaxially oriented sheet.

L4: For the purpose of this example a standard commercial photographic paper base was used.

L5: This is a melt polymer layer of low density polyethylene coated at 12.2 g/m$^2$ to provide adhesion between the base and biaxially oriented sheet.

L6: Is a 2 layer matte film of biaxially oriented polypropylene with the matte side next to the fusible layer. The matte layer is a terpolymer mixture of propylene, ethylene and butylene L7: The fusible layer is a thin coating of polyethyleneimine coated at 0.0055 g/m$^2$. The polyethyleneimine used has a molecular weight number average of approximately 70,000 as determined by osmotic pressure.

L8: The writable conductive layer is a mixture of an styrene butyl-acrylate at 18.5% of the dry weight and a sodium styrene sulfonate, aluminum modified colloidal silica, lithium nitrate and polyethylene oxide.

The drawing labeled as FIG. 1 is an abbreviated version of the above composite sheet. FIG. 1 is a representation of two pieces of photographic paper being spliced together in a typical heated splicing unit 15 during photofinishing. A customer roll of photographic paper 12 is exposed and at the end of the roll the web is stopped. A second unexposed roll of photographic paper 22 is moved under the first roll with a slight overlap as depicted in FIG. 1. Heated anvils 2 on the top and by 24 on the bottom are brought into contact with the top most layer of the light sensitive photographic emulsion and the bottom most layer of the second paper web. The top layer of the photographic emulsion is a protective layer comprising predominately gelatin. Heat is applied through the anvil by electrical voltage. The contact time of the anvil can typically be adjusted up to 10 seconds of contact. The heat developed in the anvil is approximately 93° to 205° C. There is enough heat, dwell time and pressure under the anvil such that the backside writable conductive layer 40 is fused to the image layer of the second roll of photographic paper 14. The importance of the fusible layer 38 is to better promote adhesion of the writable conductive layer 40 to the base substrate 36. When the bottom most portion of 6 is polypropylene and there is no fusible layer 38 and the adhesion of 40 is weak. This is best seen after the heat splicing process and is noted in table 1. In current photographic papers the bottom most layer is typically polyethylene which has acceptable adhesion to the writable conductive layer.

In FIG. 1, layer 36 is a base substrate such as photographic paper with top layer of pigmented biaxially oriented polypropylene and a layer of polyethylene to adhere the polymer sheet to the paper base. In addition 36 further comprises a bottom layer of biaxially oriented polypropylene that is also adhered to the paper base substrate. Coated on the bottom most side of 36 is a thin layer of polyethyleneimine 38.

TABLE 1

Peel Strength (Grams)

| Sample | 5 sec (160° C.) | 9 sec (194° C.) |
|---|---|---|
| A Control | 36 | 708 |
| B No fusible layer on polypropylene | 10 | 40 |
| C Fusible Layer on polypropylene | 1532 | 2420 |

As can be seen the fusible layer provides very strong splice at both low and high dwell time under the heat splicing anvil. The control (Sample A) which has the writable conductive layer coated on a cornea treated polyethylene surface and no fusing layer shows improvement as the dwell time and temperature is increased but the same writable conductive layer when coated on a cornea treated surface of polypropylene (Sample B) only has a minor improvement in splice strength as the time and temperature are increased. It is further noted that the overall splice strength is lower when the writable conductive layer is coated on polypropylene. The addition of the fusible layer on the bottom polymer layer but under the writable conductive as shown by Sample C provides improved strength at bottom low and high dwell times.

The splicing unit to test these samples has two opposing, parallel jaws that are covered with a Teflon-coated, glass cloth. Beneath the cloth of the top jaw is a 1 cm. wide metal band to which a voltage is applied to supply heat. When the heat splicer is activated the jaws come together with approximately 34.4 Mpa, a voltage is applied to the heating strip for selected duration and the jaws come apart so the sample can be removed. The paper to be tested is cut into pieces, each measuring 10.2×25.4 cm. Two pieces of paper are placed face up on top of one another and inserted into the heat splicer. A heat splice is made across the 10.2 cm width, 1.25 cm from the end. The papers are removed form the heat splice device and cut into four pieces measuring 2.33×7.6 cm with the heat splice located across the width of the paper (approximately 2.23 cm) , and approximately 1.25 cm from the end of the papers. Each end of the paper opposite the heat splice is attached to a stress-strain gauge and the papers peeled apart at a rate of 2.54 cm. per minute. The pull angle is approximately 180 degrees. The peak force required to separate the papers is captured and reported as the splice strength. In order to measure heat splice sticking, the paper to be tested is cut into a strip, measuring 2.54×25.4 cm. One end of the strip is placed emulsion side up in the heat splicer. The other end of the strip is attached to a stress-strain gauge. The paper is pulled tangent to the surface of the lower splice head that contacts the back of the paper and the peak force required to pull the paper off the splice head is captured and reported as heat splice sticking value. It is reported in grams of force.

TABLE 2

Splice Sticking (grams) Vs. Heat Head. Time (sec)

| | 3 sec | 5 sec | 7 sec. |
|---|---|---|---|
| Sample A (Control) | 2405 | 2656 | 4073 |
| Sample B (No fusible layer) | 2139 | 2885 | 3522 |
| Sample C (Fusible layer) | 0 | 2174 | 3013 |

Table 2 shows results from the control which has the writable conductive layer coated on polyethylene and the same writable conductive layer coated on matte appearing polypropylene with and without a fusible layer between said writable conductive layer and the bottom most polymer layer of the imaging base substrate. The results show that the sample with a fusible layer have significantly lower splice sticking values over a range of time under the splice head.

The invention has been described in detail with particular reference to certain preferred embodiments thereof, but it will be understood that variations and modifications can be effected within the spirit and scope of the invention.

What is claimed is:

1. An imaging element comprising a bottom layer of writable conductive material and above said writable conductive material layer a fusible layer between said writable conductive material and a substrate wherein said fusible layer material is selected from the group consisting of polyethyleneimine, polyvinylimine, laminated polymers, and modified polymers made by reacting acrylic polymers with acid groups with ethylene amines and said writable conductive layer has a surface roughness of between 0.3 to 2.0 $\mu$m.

2. The imaging element of claim 1 wherein fusible layer comprises polyethyleneimine coated in an amount between 0.001 and 0.115 g/m$^2$.

3. The imaging element of claim 2 wherein said writable, conductive layer comprises at least one material selected from the group consisting of aluminum modified colloidal silica, polyethylene oxide, salts, metallic salts, quaternary salts, quaternary acrylic copolymer latexes, polyethyloxazoline, polyethyleneimine, electroconductive polymers, conductive polymers having sulphonic acid or carboxylic acid groups, crystalline single- phase, conductive metal-containing particles comprising tin-doped indium sesquioxide, niobium-doped titanium dioxide, metal nitrides, carbides, silicides, borides, and antimony-doped tin oxide.

4. The imaging element of claim 2 wherein said substrate comprises paper having a polymer layer on the bottom.

5. The imaging element of claim 4 wherein said polymer layer comprises biaxially oriented polymer sheet below said paper and above said fusible layer.

6. The element of claim 5 wherein said fusible layer does not contain conductive material.

7. The imaging element of claim 4 wherein said polymer layer comprises melt extruded polyethylene.

8. The imaging element of claim 1 wherein said fusible layer comprises a polymer that has a glass transition point between 0 and 55° C.

9. The imaging element of claim 1 wherein said fusible layer comprises a material that has a splice peel strength of at least 100 grams/0.25 cm at a temperature of between 90° C. to 205° C. at a dwell of between 2 and 8 seconds under a pressure of at least 413.7 MPa.

10. The imaging element of claim 1 wherein said substrate comprises at least one polymer sheet.

11. The imaging element of claim 10 wherein said polymer sheet comprises polyester.

12. The imaging element of claim 11 wherein said element further comprises at least one sheet of biaxially oriented polymer adhered to said polyester sheet.

13. The imaging element of claim 1 wherein said writable conductive layer has a surface resistivity of at least of less than $10^{13}$ ohms per square.

14. The imaging element of claim 1 wherein the top layer of said element comprises gelatin.

* * * * *